United States Patent [19]

Beyl

[11] 4,138,137

[45] Feb. 6, 1979

[54] SKI BRAKE

[76] Inventor: Jean J. A. Beyl, 10 Boulevard Victor Hugo, Nevers, Niévre, France

[21] Appl. No.: 778,479

[22] Filed: Mar. 17, 1977

[30] Foreign Application Priority Data

Mar. 26, 1976 [FR] France ..... 76 08849

[51] Int. Cl.[2] ..... A63C 7/10

[52] U.S. Cl. ..... 280/605

[58] Field of Search ..... 280/605, 604; 188/5, 188/6, 8; 267/157, 164, 165, 182

[56] References Cited

U.S. PATENT DOCUMENTS

| | | | |
|---|---|---|---|
| 3,741,575 | 6/1973 | Bortoli | 280/605 |
| 3,940,158 | 2/1976 | Wehrli | 280/605 |
| 3,989,271 | 11/1976 | Riedel | 280/605 |
| 4,036,509 | 7/1977 | Schwarz | 280/605 |

*Primary Examiner*—David M. Mitchell
*Attorney, Agent, or Firm*—Bierman & Bierman

[57] ABSTRACT

Ski brake comprising a pair of braking members adapted to be disposed on either side of the ski, a transverse pivot pin extending across the ski and about which said members are adapted to pivot, and a control pedal adapted to be actuated either by the ski boot or by a ski-binding plate supporting said ski boot. Said control pedal consists of a rigid metal wire shaped to a bow configuration and rigid with said pair of braking members, and the ski brake also comprises a return spring consisting of a loop of resilient metal wire having one end attached to said control pedal and bearing with the opposite end upon the ski at a point spaced longitudinally in relation to said braking member pivot pin, the dimensions of said resilient wire loop being such that in its normal shape said resilient wire normally urges said control pedal to its raised position above the ski and said braking members to a position in which they project downwardly from the lower surface of the ski.

5 Claims, 5 Drawing Figures

1
2
3
4
5
6
7
7
8
8a
9
10
11
12
13
S

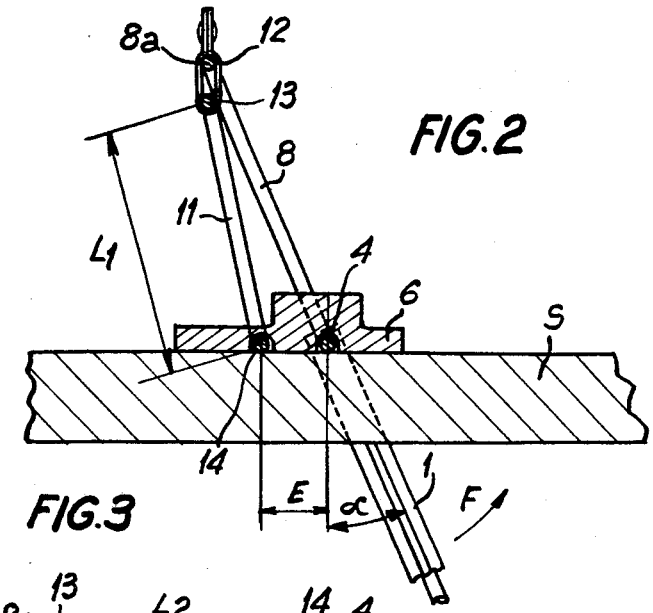
FIG.2
FIG.3
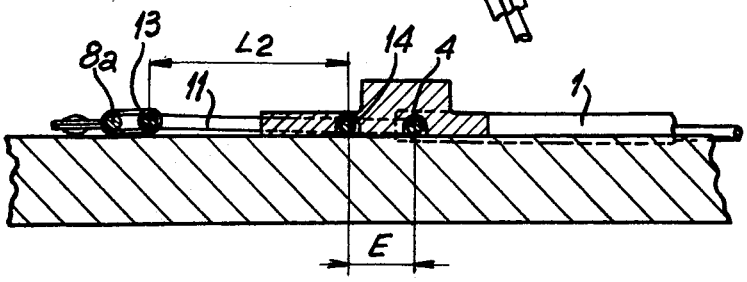
FIG.4
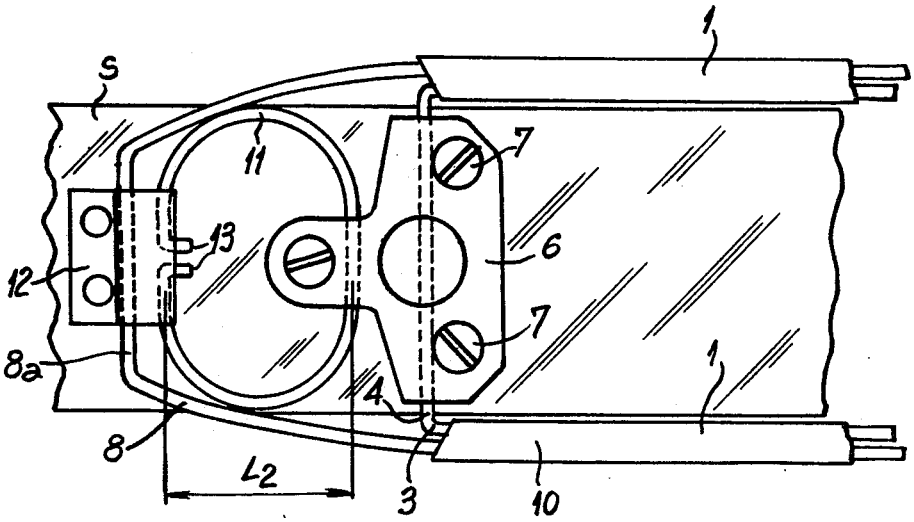

SKI BRAKE

BACKGROUND OF THE INVENTION

1. FIELD OF THE INVENTION

This invention relates to so-called ski brakes adapted to be fitted on a ski for retarding and stopping the free sliding thereof on the snow surface when the ski has been separated from the ski boot, for example in case of fall of the skier having involved the release of the corresponding safety binding.

2. DESCRIPTION OF THE PRIOR ART

The most popular ski brake devices comprise as a rule a pair of pivoting braking members or arms extending on either side of the ski and adapted to penetrate into the snow due to the elastic force of one or several return springs. Besides, a control pedal adapted to be actuated by the skier's boot is provided, the arrangement being such that when the boot is properly positioned on the ski said braking members or arms are raised to an inoperative position.

Hitherto known devices of this type are generally very complicated and the return springs provided therein are not only fragile but of dubious or short-lived efficiency. This is due both to the specific nature of the springs utilized for this purpose and also to the manner in which said springs are mounted.

In fact, in certain known ski brake systems the braking members or arms are returned or urged to their operative position by coil springs, acting as tension springs, disposed on the external face of said braking members. These springs, which are relatively fragile, are therefore unprotected and liable to be easily damaged.

In other known devices of this character coil springs are disposed around the axis of rotation of the braking members or arms and act in the fashion of torsion springs. However, these springs are also very fragile and in addition they are objectionable in that their efficiency is also insufficient.

It is therefore the primary object of this invention to provide a device of the type broadly disclosed hereinabove, which comprises a return spring characterized not only by a particularly simple design but also by a perfect efficiency and a high mechanical strength. On the other hand, the conception of this spring is such that it will not interfere with the fitting of the braking device on the ski and also with the insertion of this device under the ski boot when the latter is in its skiing position.

SUMMARY OF THE INVENTION

It is the primary object of the present invention to provide a ski brake comprising a pair of braking members or arms extending normally on either side of the ski and adapted to pivot about an axis disposed across the ski, said members being both rigid with a control pedal adapted to be actuated by the skier's boot or the fastening or mounting plate supporting said boot, and a return spring constantly urging said pair of members to a position in which they project downwards in relation to the bottom surface of the ski, so that in this position of the braking members said pedal projects above the ski top surface, this ski brake being characterized in that said spring consists of a loop of resilient metal wire having one end attached to the control pedal and the other end adapted to bear against the ski at a point off-set longitudinally in relation to the pivot axis of said arms, the dimentions of said loop of resilient metal wire being such that in its normal position said loop constantly urges said control pedal is its raised or operative position.

According to another feature characterizing the present braking device the control pedal consists of a rigid bow of metal wire encompassing said spring-forming metal wire loop having one end attached to the top portion of said rigid bow constituting the control pedal.

However, other features and advantages of this device will appear as the following description proceeds with reference to the attached drawing given by way of example and illustrating diagrammatically by way of example two typical forms of embodiment of the present invention. In the drawing:

FIG. 2 is a longitudinal section showing the device in the same position;

FIG. 3 is a view similar to FIG. 2 showing the same device but retracted in its waiting position;

FIG. 4 is a plane view from above showing the same device in the position shown in FIG. 3.

DESCRIPTION OF THE PREFERRED EMBODIMENTS

Figure 1:
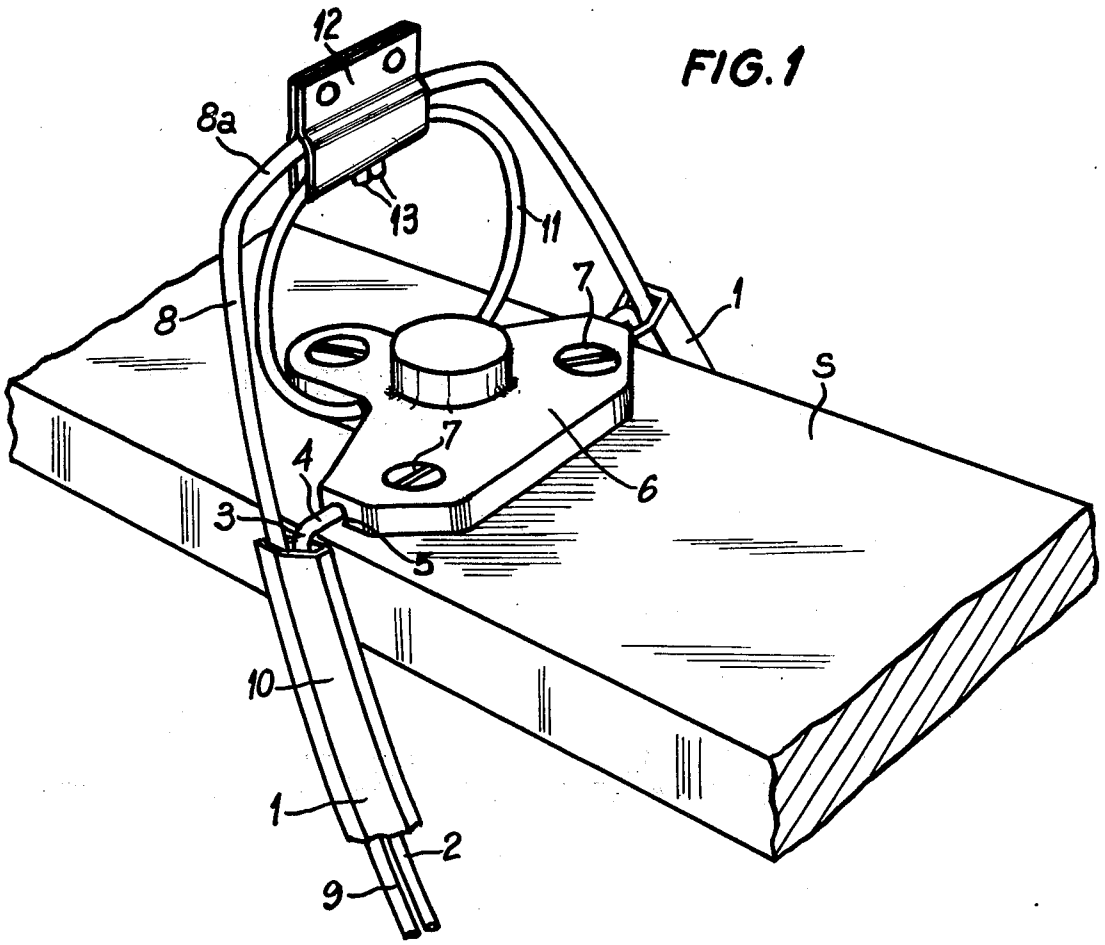
FIG. 1 is a perspective view of the present device illustrated in its operative position.

The device according to this invention for braking a ski detached accidentally or not from the ski boot comprises a pair of lateral braking members 1 extending on either side of the corresponding ski S. These lateral members 1 consist of the side arms or branches 2 of a bow 3 of rigid wire metal of which the intermediate, central or transverse portion 4 extends above the corresponding ski S to constitute the pivot axis of said braking members 1.

For this purpose, this intermediate portion 4 is rotatably mounted in a transverse groove or channel 5 formed in a plate 6 constituting the mounting base of the device. This plate 6 is secured to the top surface of the ski by means of screws 7 or any other suitable fastening means or members.

The present device further comprises a control pedal consisting of another, bow-shaped member 8 of rigid metal wire of which the side arms also extend laterally on either side of the ski S, the lower portions 9 of these arms being rigidly connected to the lateral arms 2 of the first bow 3 in order to constitute therewith the pair of braking members 1 of the device. The lateral arms of the two bows are assembled on either side by means of a sleeve 10 of plastic material or any other suitable material.

The pivot pin 4 lies intermediate the ends of said lateral arms of said second bow 8. In fact, the intermediate portion **8*a*** of this bow is normally adapted to project above the ski surface to constitute the control pedal proper.

Thus, when the ski boot is not placed on the ski and does not depress this intermediate bow portion **8*a***, the latter is raised above the ski and retained in this position.

For this purpose, a return spring is provided. This spring consists of a loop 11 of resilient metal wire which is encompassed by the bow 8 constituting the control pedal, above the pivot pin 4. One end of this loop 11 is attached to the control pedal, that is, to the intermediate or horizontal section **8*a* of bow 8, by means of an elongated collar 12 comprising a pair of holes engaged by the two bent end portions of the rigid metal wire constituting the return-spring forming loop 11**.

The opposite end 14 of this resilient loop bears on the top surface of the ski S along a transverse line somewhat off-set, in the longitudinal direction, by a distance E, from the position of the pivot pin 4. This relative distance or spacing between the pivot pin 4 and the transverse section of loop 11 is opposite the side where the control pedal 8 is normally pressed against the ski, when the ski boot bears thereon. As a rule, this distance E is disposed at the rear, with the braking members 1 inclined forwardly and downwardly, as illustrated in FIGS. 1 and 2, when they are in their operative position.

This operative position is determined by the shape normally imparted to the spring-forming resilient loop 11 in its unstressed condition. Therefore, this shape is such that the loop holds the control pedal 4 raised above the ski surface with the braking members 1 inclined forwardly and downwardly at an angle $\alpha$ to the vertical, the value of this angle being in the range of 20° to 45°, preferably about 30°.

When the ski boot is positioned on the ski, it exerts a pressure on the control pedal 8*a* and consequently causes the braking members to pivot about the pivot pin 4 in the direction of the arrow F (FIG. 2). These two members are thus brought to their raised, retracted position as illustrated in FIGS. 3 and 4. On the other hand, the control pedal 8*a* is pressed against the ski as shown in the same Figures.

However, the application of this pedal 8*a* against the ski surface, as a consequence of its rotation about the pivot pin 4, is attended by an elastic distortion of the spring-forming resilient loop 11, which assumes a substantially oval shape (FIG. 4). This is due to the fact that in the folded position the length $L_2$ existing between the two ends of this elastic loop is shorter than the length $L_1$ existing between said ends when the elastic loop is unstressed.

Of course, this difference in length is due to the distance E existing between the pivot pin 4 and the transverse portion 14 of loop 11 which bears on the ski.

Therefore, said loop 11 is constantly under resilient stress when pressed down against the ski surface. It will thus tend to cause the control pedal 8*a* to move upwards and consequently the braking members 1 to pivot about the pivot pin 4 when the boot (not shown) is removed, for example in case of fall of the skier involving the release of the binding normally retaining the boot on the ski.

Due to its specific configuration, this elastic loop 11 constitutes a spring having an efficiency considerably greater than that of conventional coil springs made of thin metal wire as provided on certain known prior art ski braking devices. Besides, this spring is particularly sturdy and strong, and cannot weaken as a consequence of prolonged use.

However, another advantage characterizing this invention lies in the fact that the spring-forming elastic loop consists of a member definitely separate from the control pedal and the braking members. Thus, this control pedal and the braking members can be made from very rigid metal wire stock, therefor from a particularly resistant material, whereby the efficiency of said braking members when they penetrate into the snow is particularly high.

If desired, the elastic loop 11 may be made from metal wire of smaller cross-section, having an elasticity consistent with the function for which said loop is intented. Besides, this loop is also characterized by a particular shape enabling it to undergo an elastic distortion in a same and single plane, namely the plane of loop 11, through a more pronounced curvature of its lateral arms, thus producing an ovalization of the entire loop.

However, it would not constitute a departure from the scope of this invention to provide a loop 11 having different shapes or configurations. Besides, two or more spring-forming elastic loops may be provided instead of a single loop.

The position of the pivot pin 4 with respect to the bearing line 14 of the spring-forming elastic loop 11 may if desired by inverted in comparison with the above-described form of embodiment.

In this case, the distortion of the elastic loop 11 is obtained by extension rather than by compression when the control pedal is pressed against the ski. Of course, this elastic loop 11 may then have a shape and structure consistent with this specific mode of operation.

Another advantage characterizing this device lies in the simplified mounting of the spring-forming elastic loop 11, and also in its very moderate over-all dimensions. In fact, when the device is in the waiting position illustrated in FIGS. 3 and 4, the resilient loop 11 does not project above the plane of the bow 8 constituting the control pedal. This will obviously avoid in the practical use and mounting of the device all the difficulties currently encountered with various known braking devices.

Another advantage still of the present invention resides in the fact that in the waiting position of the device the control pedal exerts a pressure of relatively limited value on the boot sole, thus avoiding any interference with the release of said boot when the safety ski binding operates. This feature is due to the fact that with the present arrangement the pedal 8*a* is very close to the plane containing the pivot pin 4 and the bearing section 14 of the elastic loop constituting the return spring of the device.

Of course, this invention should not be construed as being strictly limited by the single form of embodiment described hereinabove with reference to FIGS. 1 to 4 of the drawings. In fact, instead of two metal wire bows 3 and 8 imbricated in each other and having unequal lengths, this device may incorporate only one bow, namely bow 8, the pivot pin 4 consisting of a cross member secured at its opposite ends to the lateral arms of said bow.

Besides, instead of consisting of metal wire, the braking members and the control pedal may be constructed in any other suitable and desired manner. Thus, it would also be possible to provide two parallel members interconnected by a pair of cross members constituting the pivot pin and the control pedal 8*a*, respectively, these members consisting for example of punched metal blanks or any other suitable material, and being obtained if desired through any other suitable method.

Figure 5:
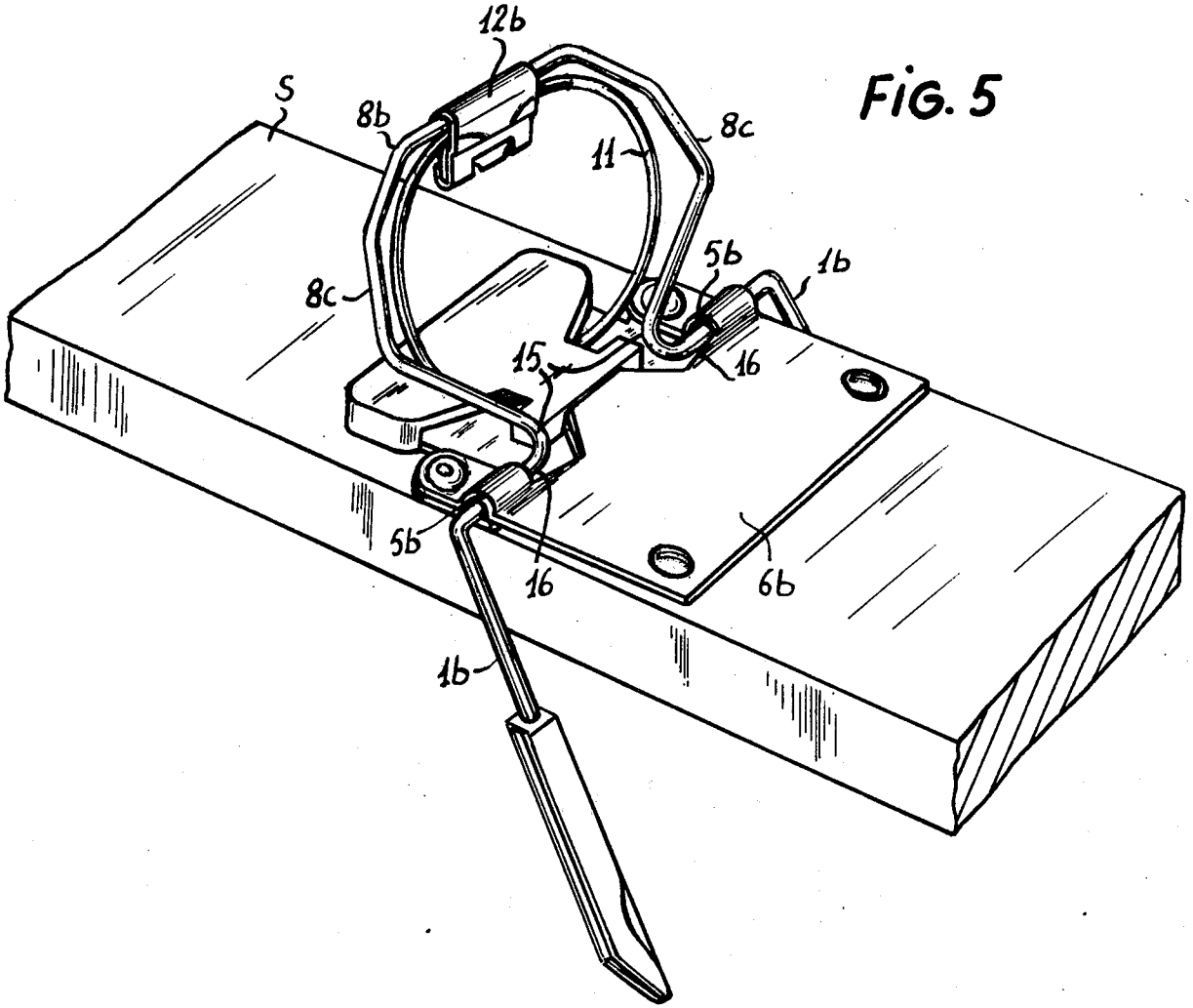
FIG. 5 is a perspective view showing a modified form of embodiment of the ski brake device of this invention.

FIG. 5 illustrates a modified form of embodiment of the braking device of this invention wherein the two lateral arms 8*c* of the rigid bow 8*b* constituting the control pedal comprise each an elbow 15 formed inwardly so as to provide two rectilinear portions 16 adapted to constitute the aligned pivot pins of said control pedal. These two aligned rectilinear portions extend across the top surface of the ski and are trunnioned in bearings 5*b* formed integrally in a base member 6*b* rigidly secured to the ski, as shown. Beyond the two pivot-pin forming rectilinear portions 16 the two arms 8c of said rigid bow 8d are bent at right angles and downwardly to constitute the pair of lateral braking members 1b of the device.

The spring means constantly urging the pedal 8b to its operative position consists as in the preceding form of embodiment of a loop 11 of metal wire adapted to undergo an elastic distortion.

One end of the loop is attached to the upper transverse portion of pedal 8b by means of an elongated connecting collar 12b. The opposite end of said loop bears on the top surface of the ski along a transverse line somewhat spaced with respect to the pivot pin constituted by the two above-defined portions 16 of the pedal.

Thus, as in the first form of embodiment described hereinabove, the spring is completely separate from the control pedal which is actuated by the boot to keep the braking members in their retracted position. Therefore, this spring may consist of a very resilient metal wire, in contrast to the control pedal and the braking members which are made from relatively thick metal wire having the maximum rigidity.

What is claimed as new is:

1. A ski brake of the type adapted to be mounted on a ski and controlled either by the presence or absence of a ski boot or ski binding plate, comprising a pair of rigid braking members disposed on either side of the ski, means pivotally supporting said braking members for vertical movement, mounted transversely of said ski, a brake control pedal positioned on the upper surface of the ski comprising a rigid bow-shaped member having a bow portion positioned above the upper surface of the ski and engageable by the ski boot or ski binding plate, and a pair of side arms respectively rigidly attached to said braking members, spring means normally urging said pedal upwardly and the attached braking means downwardly into a ski-braking position, said spring means comprising a resilient metal wire loop, means pivotally and transversely mounting one side of said loop on said ski, longitudinally displaced thereon relative to the pivotal mounting of said braking members, and means attaching the opposite side of said loop to the bow portion of said control pedal, whereby when said control pedal is depressed by the pressure of the ski boot or ski binding plate said braking means are moved to a substantially horizontal nonbraking position and said wire loop is distorted to provide a return spring action when said pressure is removed to effect a downward braking position of said braking means.

2. Ski brake according to claim 1, wherein said spring-forming resilient metal wire loop is disposed between the side arms of said rigid metal wire bow constituting said control pedal.

3. Ski brake according to claim 1, in which the means pivotally mounting said braking members comprise a second rigid bow having its horizontal portion pivotally mounted on said ski, in combination with means rigidly attaching its side arms to the respective side arms of the first bow to form with them said pair of braking members.

4. Ski brake according to claim 2, in which said braking members are formed by extended portions of said side arms, and in which said pivotally supporting means pivotally support such extended portions.

5. Ski brake according to claim 4, in which the extended portions of said side arms are each first bent at a substantially right angle to form a transverse portion supported by said pivotally supporting means, and then bent again at a right angle to form said braking members.

* * * * *